US006688076B1

(12) United States Patent
Rivera, Jr.

(10) Patent No.: US 6,688,076 B1
(45) Date of Patent: Feb. 10, 2004

(54) APPARATUS FOR WRAPPING ARTICLES IN FILM MATERIAL

(76) Inventor: Victor M. Rivera, Jr., 46 Sylvan Ave., Meriden, CT (US) 06451

( * ) Notice: Subject to any disclaimer, the term of this patent is extended or adjusted under 35 U.S.C. 154(b) by 0 days.

(21) Appl. No.: 10/158,667

(22) Filed: May 30, 2002

(51) Int. Cl.[7] ..... B65B 25/24
(52) U.S. Cl. ..... 53/204; 53/587; 53/588
(58) Field of Search ..... 53/204, 211, 587, 53/588; 100/12, 27, 28; 242/434.2, 434.5

(56) References Cited

U.S. PATENT DOCUMENTS

| | | | | | |
|---|---|---|---|---|---|
| 1,630,834 | A | * | 5/1927 | Derry | 53/204 |
| 1,660,602 | A | * | 2/1928 | Du Voisin et al. | 53/204 |
| 1,841,609 | A | * | 1/1932 | Labine | 53/204 |
| 1,953,725 | A | * | 4/1934 | Ruesch | 53/204 |
| 2,254,934 | A | * | 9/1941 | Brown | 53/204 |
| 2,346,475 | A | * | 4/1944 | Desautels | 53/204 |
| 3,084,879 | A | * | 4/1963 | Caldwell | 53/204 |
| 3,100,089 | A | * | 8/1963 | Norrholm | 242/434.2 |
| 3,446,446 | A | * | 5/1969 | de Bruin | 100/27 |
| 4,829,753 | A | * | 5/1989 | Bricmont | 53/588 |
| 5,282,347 | A | * | 2/1994 | Cleine et al. | 53/204 |

* cited by examiner

*Primary Examiner*—Stephen F. Gerrity
(74) *Attorney, Agent, or Firm*—Pearne & Gordon LLP

(57) ABSTRACT

Apparatus for wrapping articles having a central axial opening includes a guide arm and article turning gear. The guide arm supports a ring member in the form of a split frame having an inside and outside diameter. A drive wheel is mounted on the guide arm, is rotatable about a vertical axis and is in frictional engagement with the outside diameter of the ring member. A plurality of guide rollers, mounted upon the guide arm and which support the ring member, are angularly spaced apart about a ring axis and rotatable about vertical axes, and are disposed adjacent to both the inside and outside diameters of the frame of the ring member. Film material carriage spools are adjustably mounted on the ring member and carried by the ring member through the central axial opening and around the external surfaces of the coil. The ring member is rotatable about the ring axis and causes the film carriage spools to follow an orbital path. In a first embodiment of the invention, the film carriage spools follow an orbital path by the use of a cam device. In a second embodiment of the invention, the film carriage spools follow an orbital path by the use of a film holding arm. The article turning gear positions and supports the article, and then rotates the article during the wrapping process.

25 Claims, 12 Drawing Sheets

APPARATUS FOR WRAPPING ARTICLES IN FILM MATERIAL

BACKGROUND OF THE INVENTION

1. Field of the Invention

This invention relates generally to wrapping machines and, more particularly, to wrapping machines for wrapping film material or the like around metal coils such that the film material is deposited on the coil in overlapping layers which extend through a central opening of the coil.

2. Description of the Related Art

While this invention will be described principally with reference to wrapping metal coils with a central opening, it will be appreciated that many other types of annular products with a central opening, such as wire, paper, cable, tires, etc., can also be wrapped according to the invention.

In order to protect the metal coils, it is conventional practice to wrap the coils in a substantially water impermeable, pliable, flexible wrapping medium such as a stretch wrap thermoplastic film, such as polyvinyl chloride or polyethylene, which is chemically inert, provides protection against water and other liquids, vapors and gases, and which tends to cling to itself.

The film is stretched prior to or during application and due to its property of memory, it then seeks to return to its unstretched state. Such film materials are generally applied in either sheet form, wherein the entire article to be wrapped is simply enveloped in the sheet and any side seams may be heat sealed, or in strip form in which a strip of film is wound continuously around the article, which is rotated about an axis perpendicular to the axis of wrap application during wrapping so that eventually the entire peripheral surface of the article is covered. The devices that relate to the strip form of wrapping film typically use a separate film tensioning device for maintaining a suitable film tension. These devices constantly require adjustment by trained mechanics in order to maintain the suitable film tension required for proper wrapping to take place.

There is a need, therefore, for an improved wrapping method and apparatus which will provide complete, hermetic, protection for the wrapped metal coil without the addition of a separate film tensioning device for maintaining a suitable film tension during the wrapping process.

SUMMARY OF THE INVENTION

This invention provides a method and apparatus for wrapping a coil having a central axial opening in film material without the use of a separate film tensioning device for maintaining a suitable film tension. The method and apparatus includes the use of a guide arm and article turning gear. The guide arm, in turn, supports a ring member. The ring member is in the form of a split frame having an inside and outside diameter and rotates about a ring axis.

A drive wheel is mounted on the guide arm. The drive wheel is rotatable about a vertical axis and is in frictional engagement with the outside diameter of the ring member. The drive wheel may be driven by a motor with gearing.

A plurality of guide rollers are mounted upon the guide arm and support the ring member. The guide rollers are angularly spaced apart about the ring member axis and rotatable about vertical axes. The guide rollers are disposed adjacent to both the inside and outside diameters of the frame of the ring member.

A film material carriage member containing a film roll is adjustably mounted on the ring member and the film roll is carried by the ring member through the central axial opening and around the external surfaces of the coil.

Means for causing the film carriage member to follow an orbital path are provided. The orbital path introduced to the film material carriage member through these means, eliminates a need for having a separate film tensioning device for taking-up tension on the film material during the wrapping process.

In a first embodiment of the invention, the means for causing the film carriage member to follow an orbital path is in the form of a motorized cam device connected to a guide frame. The guide frame is mounted on linear ball slides that are attached to the guide arm. The guide arm is provided with an oscillating motion, i.e, a left-right motion.

In a second embodiment of the invention, the means for causing the film carriage member to follow an orbital path is in the form of one or more film holding arms that rotate with the ring member. The film carriage means is attached to one end of the film holding arm. The other end of the film holding arm is mounted onto the ring member. The film holding arm is provided with an elliptical motion as it rotates with the ring, member.

In each of the embodiments described above, the orbital path provided for the film carnage member is synchronized to the rotation provided by the article turning gear.

The article turning gear positions and supports the article as it loaded into the guide arm. Once loaded, the article turning gear then rotates the article during the wrapping process.

These and other aspects of this invention are illustrated in the accompanying drawings, and are more fully disclosed in the following specification.

DETAILED DESCRIPTION OF THE INVENTION

Figure 1A:
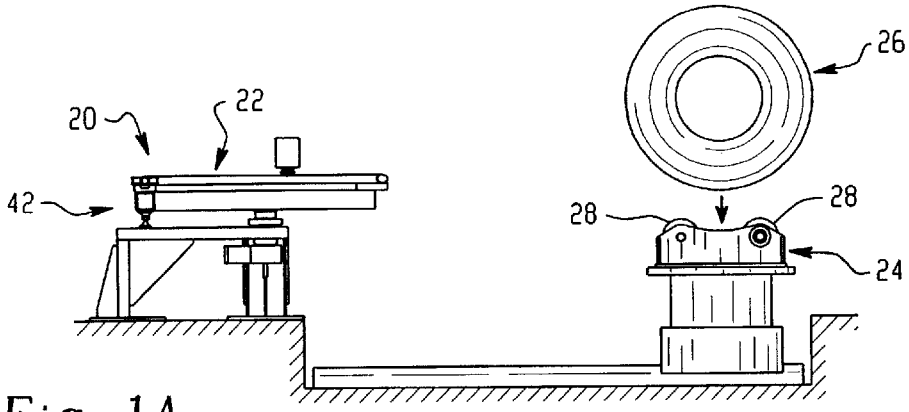
FIGS. 1A–D present a schematic illustration, in sequence, of a coil being loaded into a wrapping apparatus of the invention.
Figure 1B:
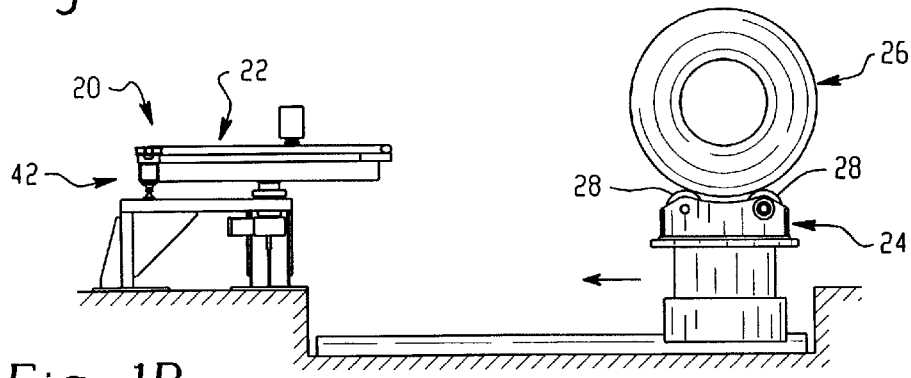
Figure 1C:
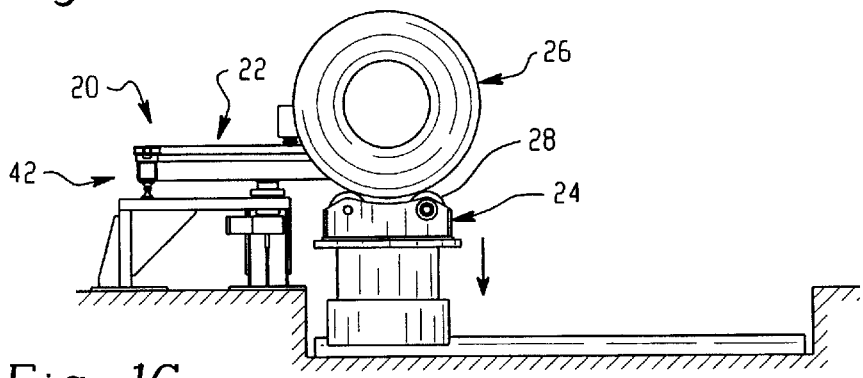
Figure 1D:
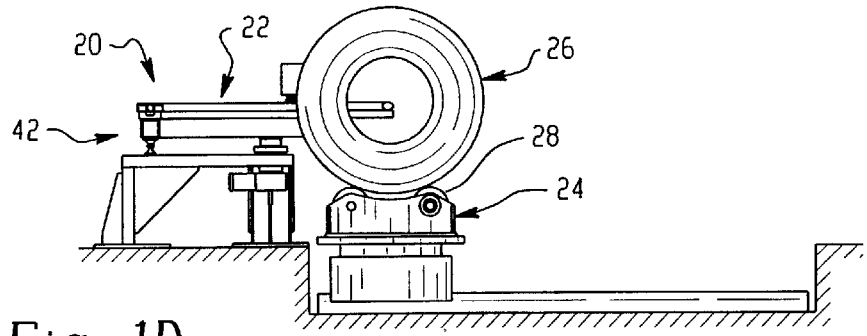

Referring now in greater detail to the drawings wherein the illustrations are for the purpose of illustrating example embodiments of the invention only and not for the purposes of limiting the invention, a wrapping apparatus 20 in accordance with the present invention includes, as described hereinafter, a guide arm assembly 22 and an article turning gear, for example as when wrapping a steel coil, a coil car 24. The article turning gear is a device suitable for rotating the article.

In order to initiate the wrapping process, for example, as illustrated in FIGS. 1A–D, an operator loads a coil 26 onto the coil car 24. Once the operator places the coil onto the coil car 24, the coil car moves the coil 26 into position into the guide arm assembly 22. Coil car wheels 28 support the coil 26, while the coil 26 is positioned into the guide arm assembly 22. Once the coil is positioned by the coil car, coil car wheels 28, then rotate the coil 26 during the wrapping process.

A first embodiment of the wrapping apparatus 20 is best seen in FIGS. 2–5. A guide arm assembly 22 includes three upright support legs 30, 32, and 34, each of which includes a floor mounting plate, a vertical channel and support gussets. The support legs 30, 32, and 34 secure the guide arm assembly 22 to the ground and in relation to the coil car 24, as illustrated in FIGS. 1A–D.

Figure 2:
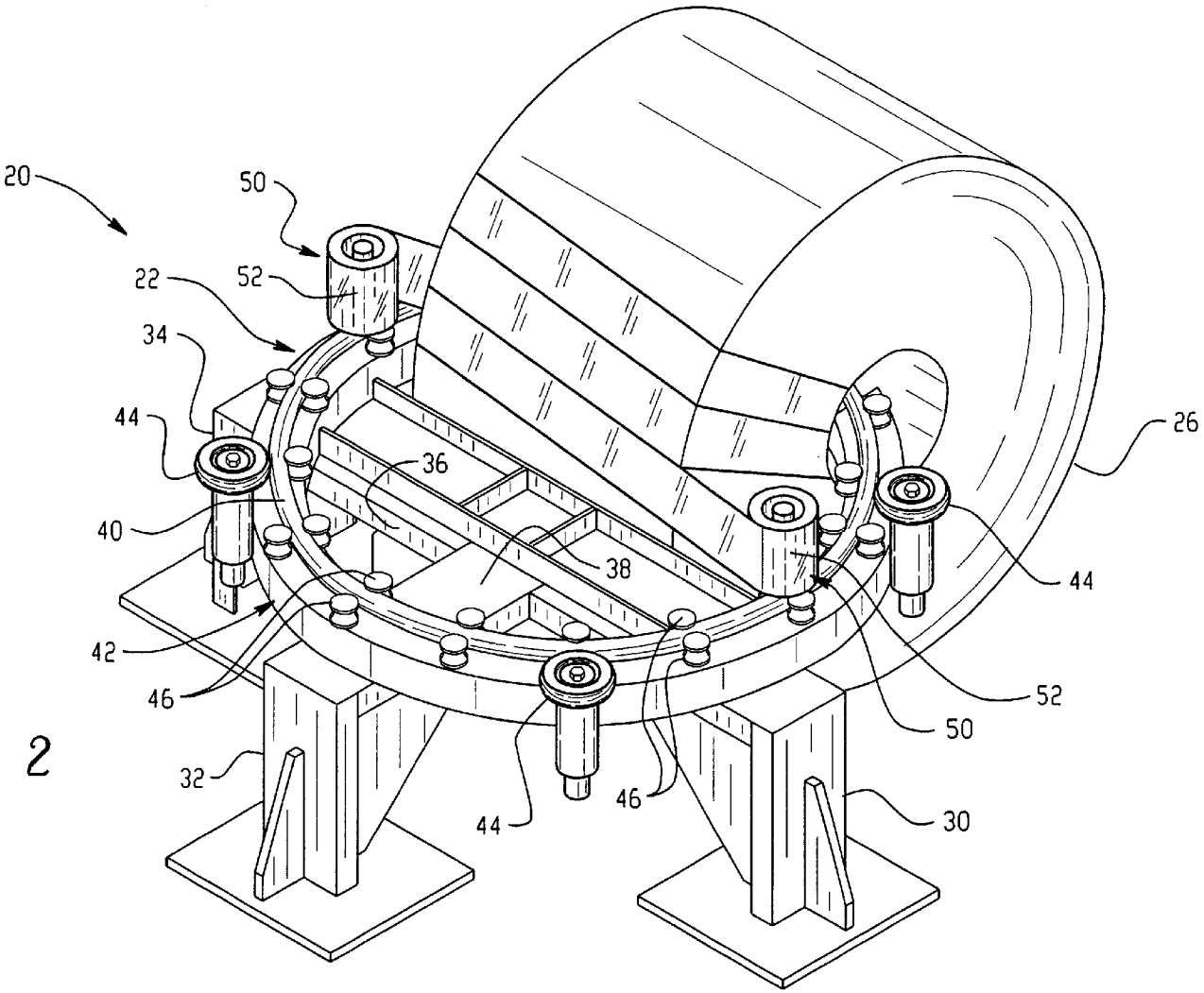
FIG. 2 presents a perspective view of a first embodiment of the wrapping apparatus of the invention.

As shown in FIG. 2, guide arm assembly 22 further includes a cross member 36 between support legs 30 and 34 and, it will be appreciated that a corresponding cross member 38 is provided between support leg 32 and cross member 36. Support gussets are provided on the cross members 36, 38 as required. The support legs 30, 32, 34 and cross members 36, 38 are suitably interconnected, such as by welding, and once interconnected, define a base frame. The base frame may constitute any combination of support legs and cross members that are interconnected, such as by welding, that will provide the support required for the guide arm assembly 22.

Figure 3:
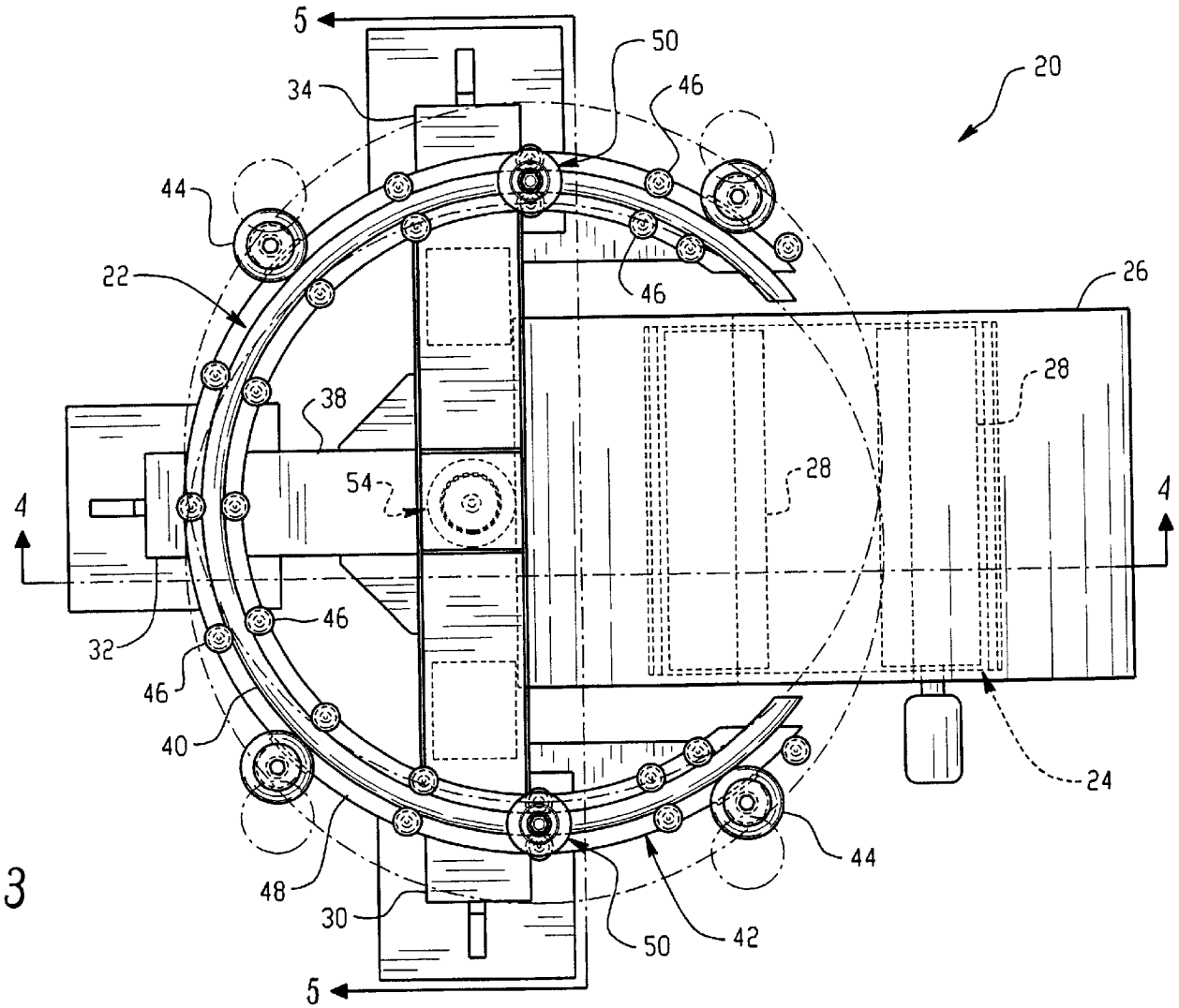
FIG. 3 presents a plan view of a first embodiment of the wrapping apparatus including an illustration of the path of a ring member in a fully oscillated right and left position.
Figure 4:
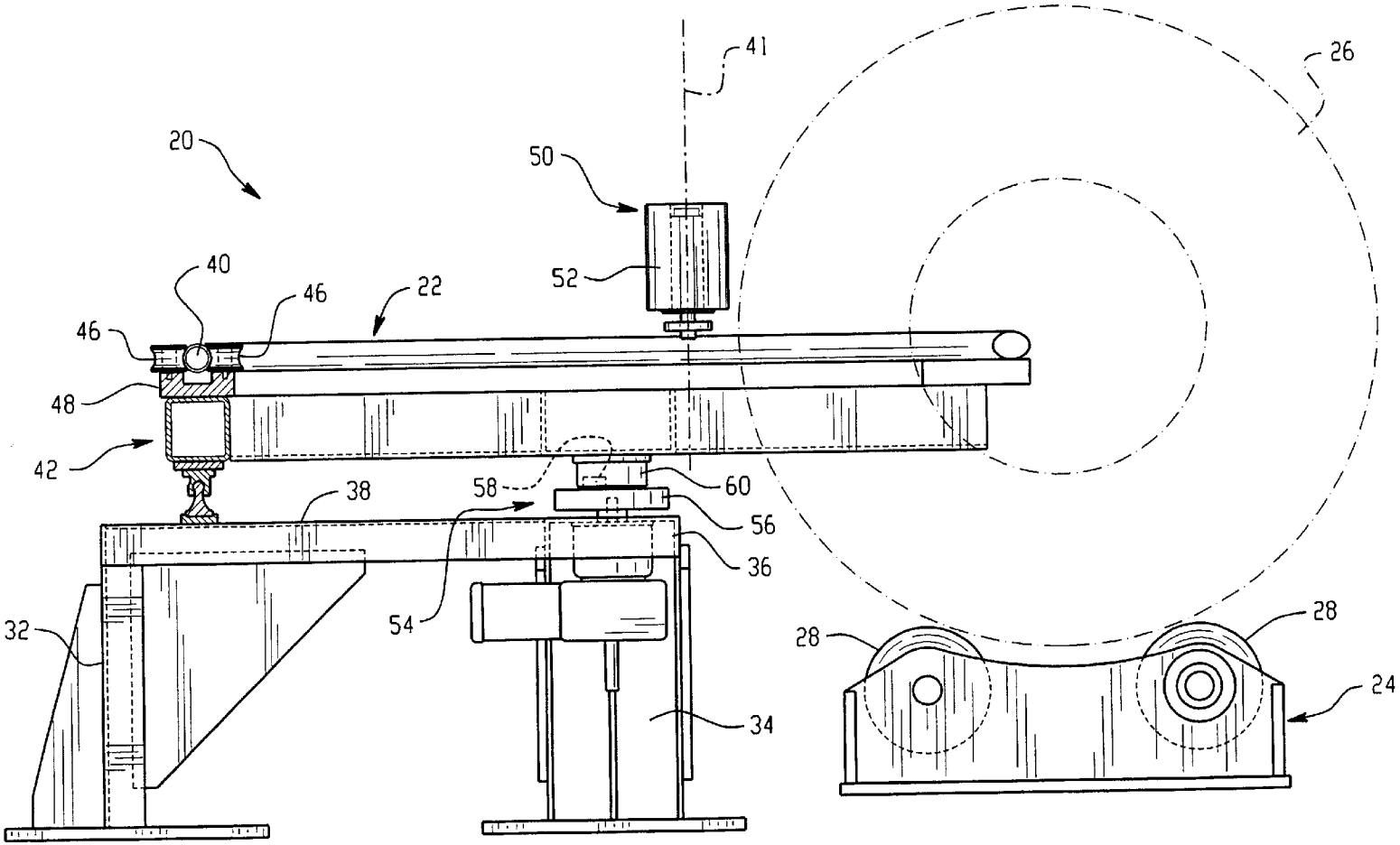
FIG. 4 presents a cross-sectional view of a first embodiment of the wrapping apparatus taken along line 4—4 of FIG. 3.

As shown in FIGS. 3 & 4, a ring member 40 is mounted on the guide arm assembly 22. The ring member 40 is comprised of a split tubular frame, having an inside and outside diameter. The ring member 40 is adapted to be rotated about a ring axis 41 (FIG. 4).

Figure 14:
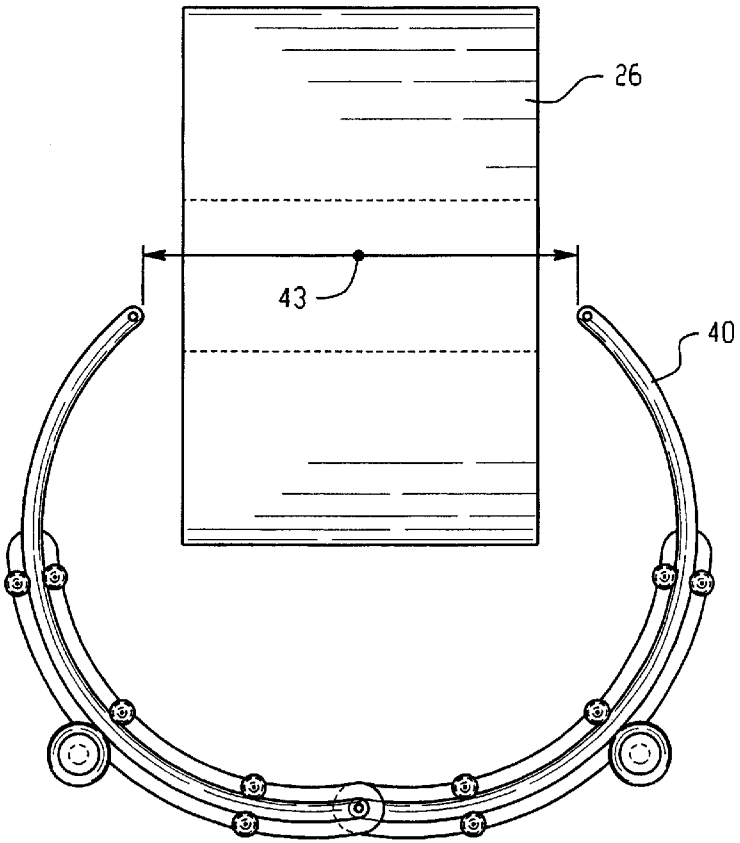
FIG. 14 presents a plan view of an alternative ring member that may be used in both embodiments of the present invention.
Figure 13:
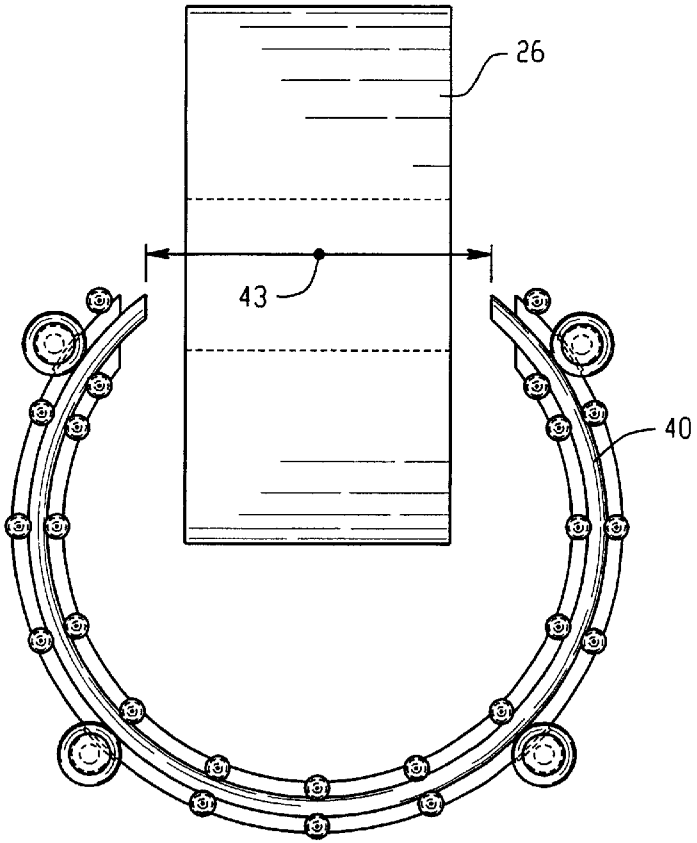
FIG. 13 presents a plan view of the ring member as shown in both embodiments of the present invention.

As best shown in FIG. 13, ring member 40 has an inside and outside diameter and the diameters are sized to minimize a necessary chordal opening distance 43 depending on the coil 26 that is being wrapped. The chordal opening distance 43 or split, on the ring member 40 is required to provide a means of loading and unloading the coil 26 that is being wrapped. The opening distance of the split is calculated such that it is of a sufficient distance to permit the coil 26 to enter the ring member 40, while minimizing the ring diameters, and consequently the wrapping time. As illustrated in FIG. 14, the split on the ring member 40 may also be designed such that the frame is hinged on one side and a male/female connection is provided on the opposite side.

Guide arm assembly 22 further includes guide frame 42 (FIG. 4). Guide frame 42 takes the form of a split annular ring and is comprised of rectangular tubing. An opening on the guide frame 42 also is required to provide a means of loading and unloading the coil 26 that is being wrapped.

As will be appreciated from FIGS. 2 and 3, ring member 40 is adapted to be rotated by a ring driver, for example, friction drive wheel 44. The drive wheel 44 is rotatable about a vertical axis, and is in frictional engagement with the outside diameter of the ring member 40. At least the outer surface of drive wheel 44 is of rubber or the like to provide the necessary frictional drive, and wheel 44 is adapted to be rotated in opposite directions by for example, an electric motor and gear reducer mounted on the guide frame 42 of guide arm assembly 22. The gear reducer has an output shaft and the drive wheel 44 is suitably secured to the output shaft for rotation therewith.

Figure 5:
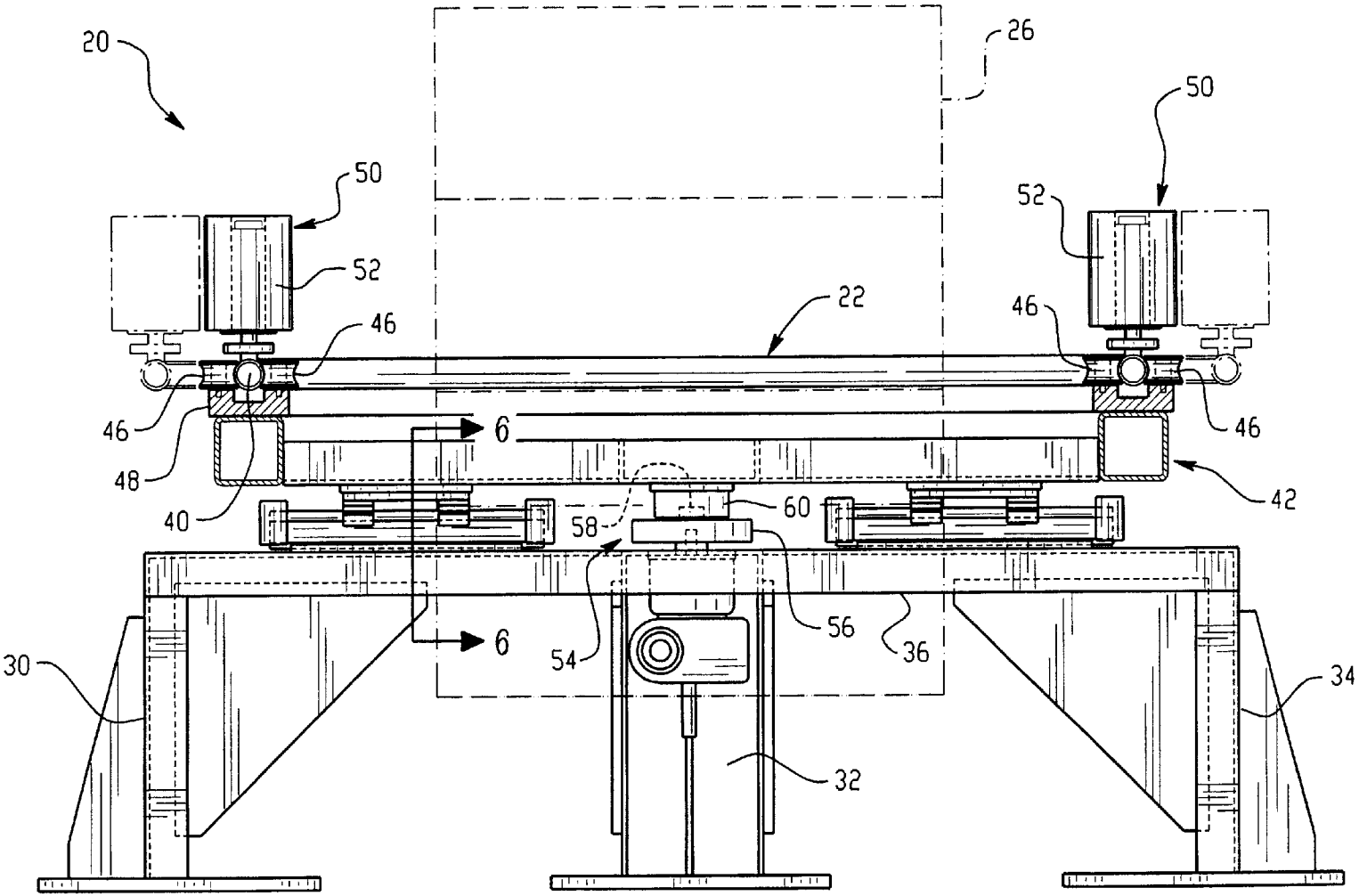
FIG. 5 presents a cross-sectional view of a first embodiment of the wrapping apparatus taken along line 5—5 of FIG. 3.

As will be appreciated from FIGS. 4 and 5, a plurality of guide rollers 46 are mounted up on the guide frame 42 of guide arm assembly 22. The guide rollers 46 support 240 degrees of the ring member 40. The guide rollers 46 are angularly spaced apart about the ring axis 41 and rotatable about vertical axes. The guide rollers 46 are disposed adjacent to both the inside and outside diameters of the split tubular frame of the ring member 40. Each of the guide rollers 46 may be made from a polyurethane or plastic material. The guide rollers 46 are mounted on brackets 48 and are formed to facilitate obtaining a desired interengaging relationship between each guide rollers 46 and its respective diameter of the split tubular frame of the ring member 40. The guide rollers 46 are radially adjustable on brackets 48. Other types of mechanical devices, such as cam followers with varying types of interengaging surfaces mounted in various interengaging directions to the ring member 40 may be used to support rotation of the ring member 40.

Figure 12:
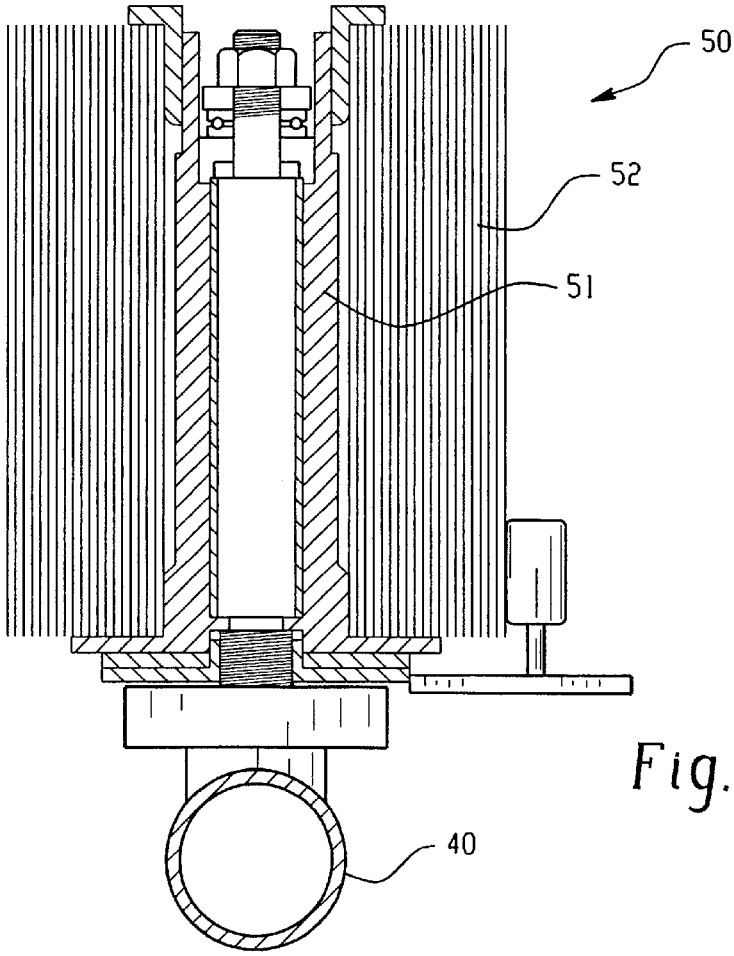
FIG. 12 presents a cross-sectional view of a spindle assembly that supports a film roll as shown in both embodiments of the present invention.
Figure 7:
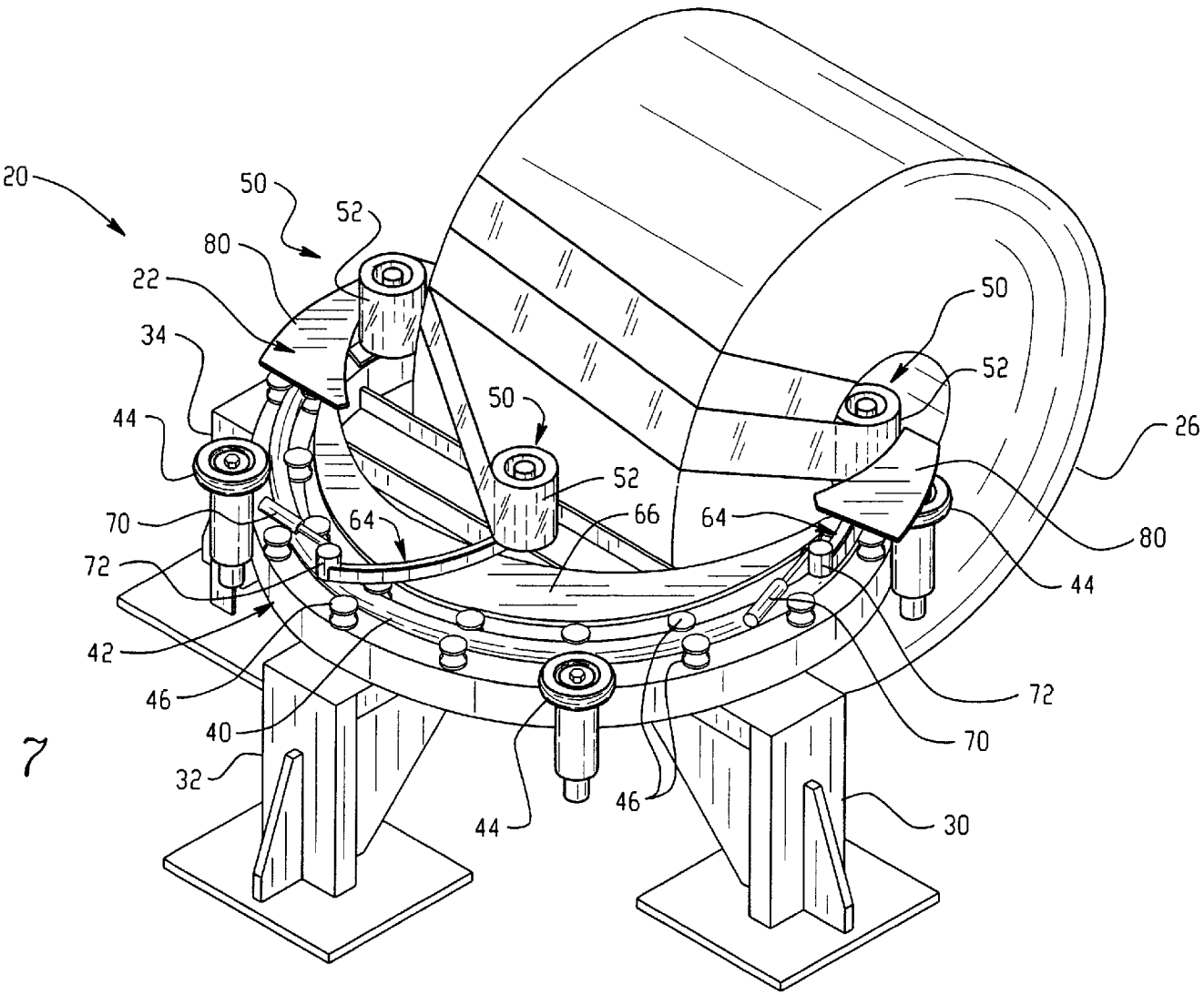
FIG. 7 presents a perspective view of a second embodiment of the wrapping apparatus.

A film material carriage member 50, for example a spool as illustrated in FIG. 12, is adjustably mounted on the ring member 40 and is carried by the ring member 40 through the central axial opening and around the external surfaces of the coil 26. The ring member 40, depending on its diameter, will accommodate several film carriage spools 50 of wrapping material, for illustration purposes, two spools are shown in the drawings (FIG. 2). The film carriage spool 50 is adjustable to provide the desired initial tension of the film material onto the coil 26 during the wrapping operation. This adjustment may be completed either manually or automatically. Carriage spool 50 is displaceable with the ring member 40 and includes a roll 52 of film material from which film is withdrawn during operation of the apparatus 20 to wrap coil 26. Once the wrapping operation is completed, the film material is severed from the roll 52 and the severed ends are attached to the coil 26. Other types of mechanical devices, such as reels, wheels, bobbins, and spindles that mount to the ring member 40 may be used to dispense the film from film roll 52.

Means for causing the film carriage spool 50 to follow an orbital path are provided. The orbital path may be a circular path or a non-circular path, such as an elliptical path. The orbital path introduced to the film material carriage spool 50 through these means, eliminates a need for having a separate film tensioning device for taking-up tension on the film material during the wrapping process.

A first embodiment of the wrapping apparatus 20 utilizes a motorized cam device, indicated generally at 54 (FIG. 4), connected to the guide frame 42, to provide the orbital path for the film carriage spool 50. As best shown in FIG. 3, the motorized cam device 54 provides an oscillating motion (a left-right motion) to guide frame 42 and correspondingly, to the attached ring member 40. The oscillating motion provided to the ring member 40 through guide frame 42 by the motorized cam device 54 produces an orbital path for the film carriage spool 50 that is synchronized to the rotational movement of the coil 26 by the coil car wheels 28 by a controller. Synchronization ensures, for example, that proper tensioning is maintained on the film and that the film layers properly overlap.

The motorized cam device 54 includes an eccentric oscillating drive hub 56 (FIG. 4) and cam follower 58 that is rotatably attached. A drive motor with gear reduction is used to drive the cam device 54. As best seen in FIG. 4, cam 60 is attached to a bottom surface of guide frame 42. Cam follower 58 engages cam 60 and provides the oscillating motion as described above to guide frame 42.

Figure 6:
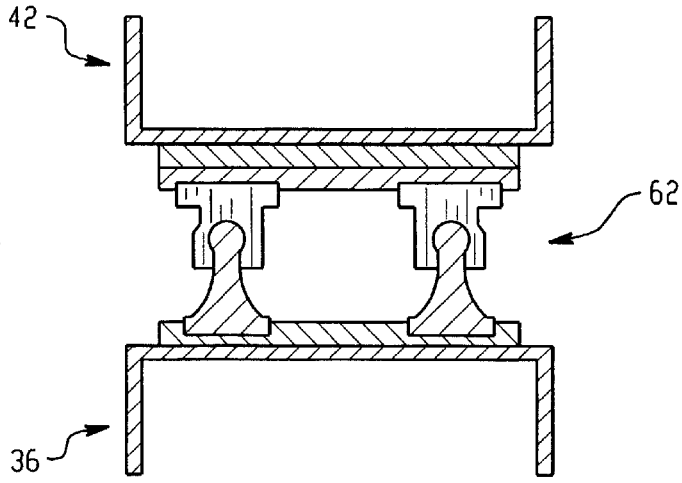
FIG. 6 presents a cross-sectional view taken along 6—6 in FIG. 5.

As will be appreciated from FIG. 6, linear ball slides 62 are located between cross member 36 on the guide arm assembly 22 and guide frame 42. As is well known, linear ball slides are used to linearly guide sliding members. In the present invention, the linear ball slides are used to maneuver guide frame's 42 left-right motion.

As illustrated in FIG. 12, the film tension may be preset by a tracer arm 84, which is located between film spindle 51 and the ring member 40. In order to provide a consistent tension as the outside diameter of the film roll 52 becomes smaller, the tracer arm 84 translates the change in the outside diameter of the film roll 52 to a proportionally variable clutch tension (not shown). The result is a consistent preset tension on the film roll regardless of the distance from center of the spindle 51 to the outer wrap of the film roll 52.

As best seen in FIG. 3, as ring member 40 is rotated, the film carriage spool 50 brings the film roll 52 through the central axial opening in the coil 26. When the film roll 52 has exited the central axial opening in coil 26, and traversed across an end face of coil 26, guide frame 42 begins to oscillate to a full left position and then to a full right position, thereby providing tension to the film on film roll 52.

A second embodiment of the wrapping apparatus 20 is best seen in FIGS. 7–10. This embodiment includes many of the features as described above in the first embodiment of the invention except that one or more film dispenser arm assemblies 64 (FIG. 11) are used. The motorized cam device 54 is not used.

Figure 8:
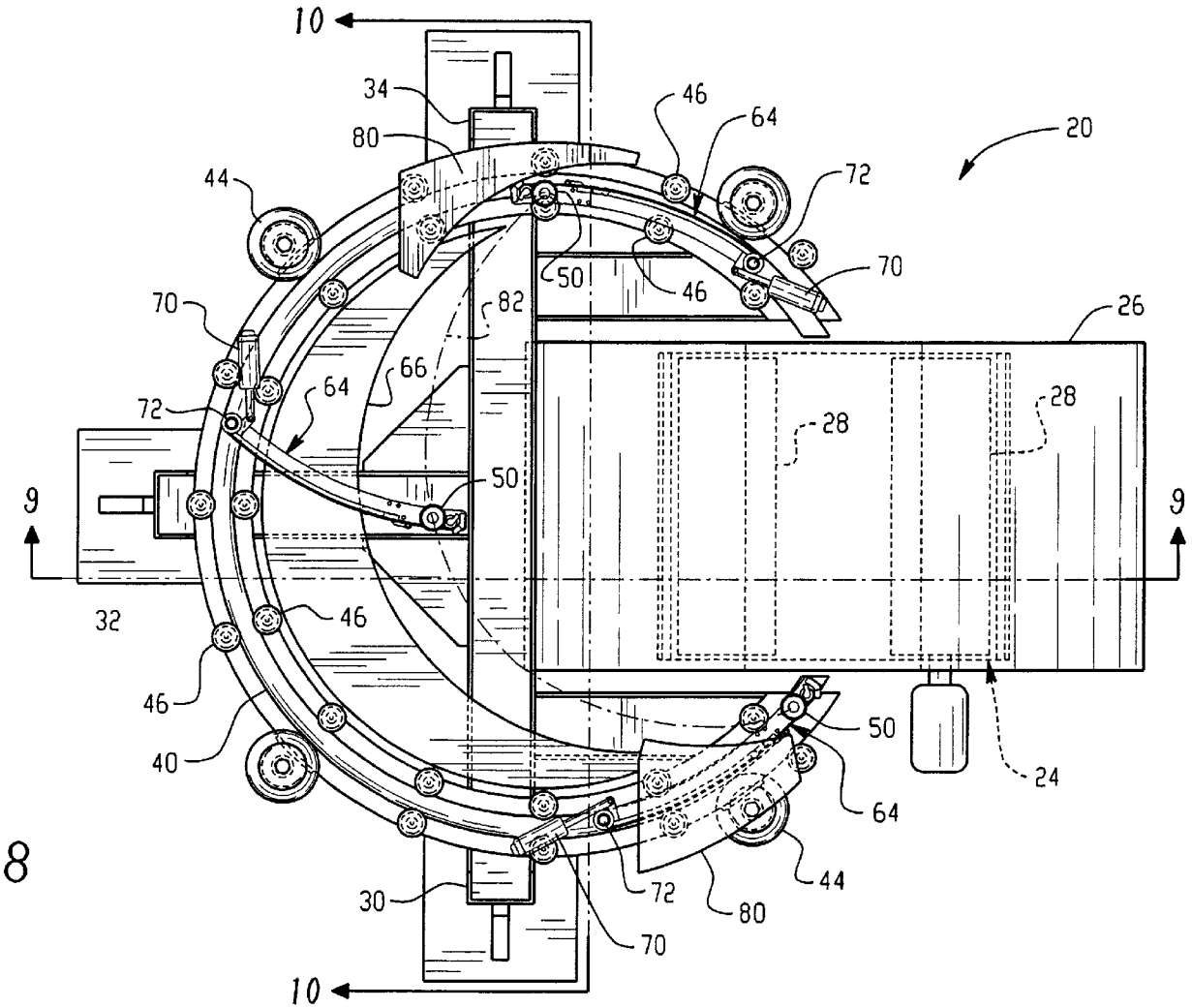
FIG. 8 presents a plan view of a second embodiment the wrapping apparatus.
Figure 9:
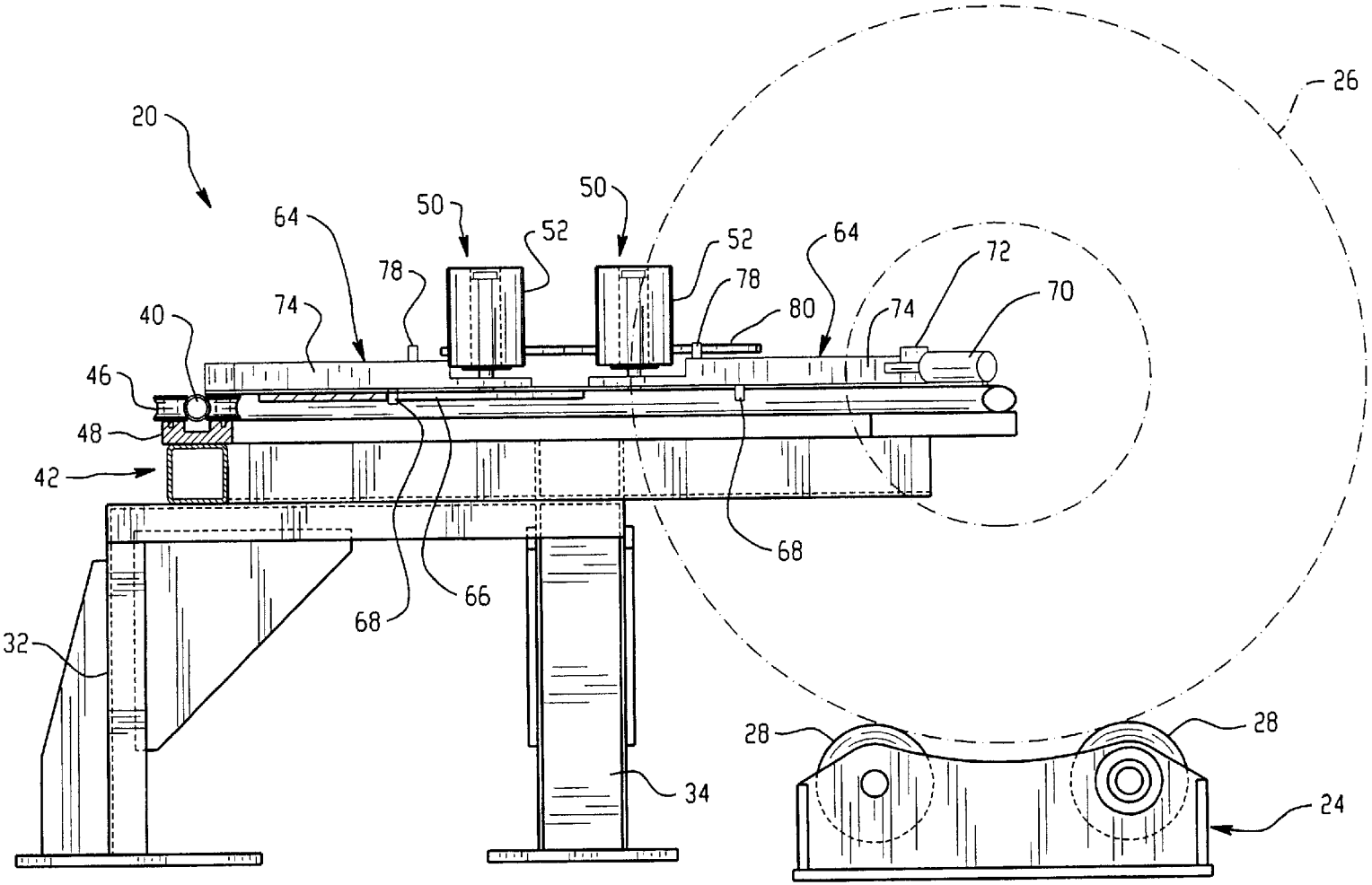
FIG. 9 presents a cross-sectional view of a second embodiment of the wrapping apparatus taken along line 9—9 of FIG. 8.
Figure 10:
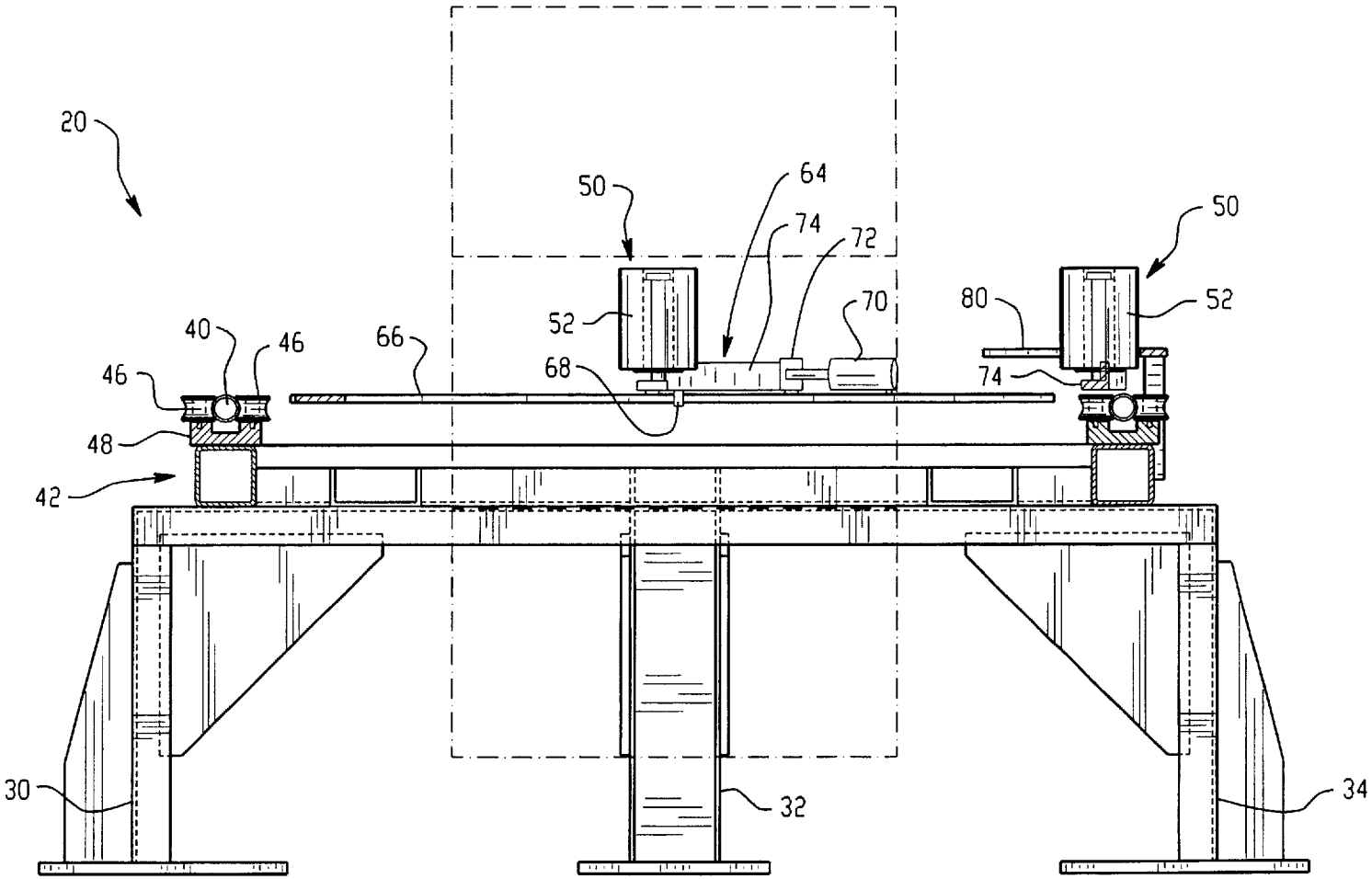
FIG. 10 presents a cross-sectional view of a second embodiment of the wrapping apparatus taken along line 10—10 of FIG. 8.

Referring to FIG. 8, film dispenser arm assembly 64 provides an elliptical motion to the film carriage spool 50 on ring member 40. The elliptical motion occurs as the arm assembly 64 rotates with ring member 40. The elliptical motion provided to the film carriage spool 50 produces an orbital path for the film carriage spool 50 that is synchronized to the rotational movement of the coil 26 by the coil car wheels 28. One or more equally spaced arm assemblies 64 may be used, depending on the application.

Figure 11:
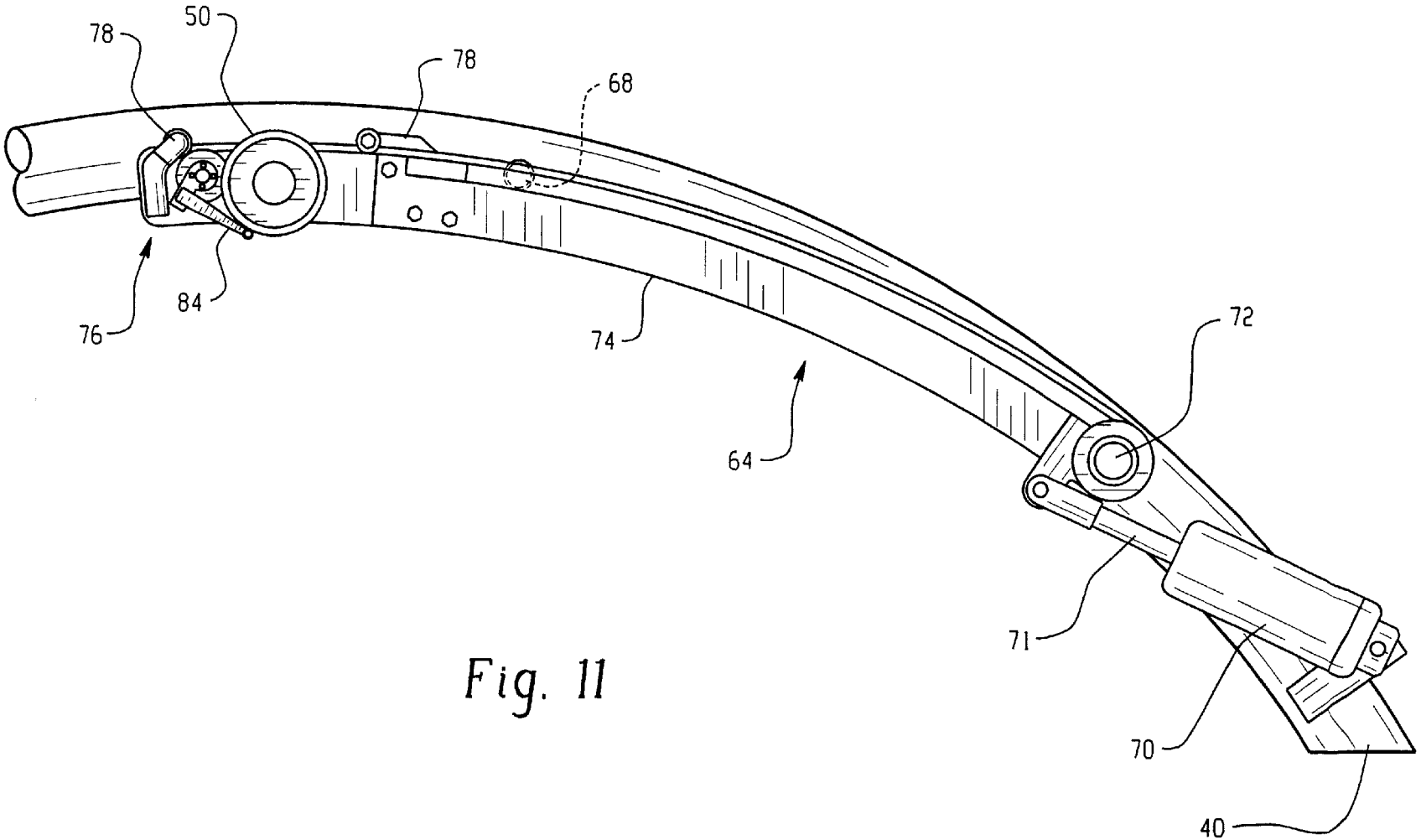
FIG. 11 presents a plan view of a film holding arm assembly used in the second embodiment of the invention.

As best shown in FIG. 11, the arm assembly 64 has the film carriage spool 50 vertically secured to one end of the arm assembly 64, and the other end of the arm assembly 64 is mounted through an anti-friction pivot 72 secured to the ring member 40. The arm assembly 64 includes an air cylinder 70, for example a 4" bore by 4½" stroke cylinder. Air cylinder 70 is filled with air, for example to 60 p.s.i. The filled air cylinder, fully extends the cylinder rod 71. The filled air cylinder acts as a pneumatic spring. The arm assembly 64 is in a home position when the cylinder rod 71 is fully extended.

A dispenser arm 74 is arc shaped and has a radius that is identical to the radius of the ring member 40. The dispenser arm 74 includes an elliptical cam plate follower 68, upper cam plate followers 78 and drag clutch assembly 76. Elliptical cam plate follower 68 is located on the lower side of dispenser arm 74. Upper cam plate followers 78 and drag clutch assembly 76 are located on the upper side of dispenser arm 74.

As best seen in FIG. 8, as ring member 40 is rotated, the film holding assembly 64 brings film carriage spool 50 with film roll 52 through the central axial opening in the coil 26. When the film roll 52 has exited the central axial opening in coil 26, and traversed across an end face of coil 26, upper cam followers 78 engage upper cam plate 80, then elliptical cam plate follower 68 engages elliptical cam plate 66. These engagements force the dispenser arm 74 to overcome the pneumatic spring and rotate about pivot 72, allowing the film roll 52 to move toward the center of ring member 40, thereby providing tension to the film on film roll 52.

As illustrated in FIG. 8, the resultant film roll path 82 is eccentric, for example elliptical, in geometry and this geometry allows for an ever increasing distance to be maintained between the film and the coil surface. The film tension is preset by the drag clutch assembly 76, which is located between film spindle 51 (FIG. 12) and the ring member 40. In order to provide a consistent tension as the outside diameter of the film roll 52 becomes smaller, a tracer arm 84 translates the change in film outside diameter to a proportionally variable clutch tension. The result is a consistent preset tension on the film regardless of the distance from the center of the spindle 51 to the outer wrap of the film roll 52.

An alternate approach to eliminating the need for having a separate film tensioning device is to provide an oscillating motion to the article turning gear. The article turning gear, such as the coil car, would generate an oscillating motion to the coil (not shown). This approach would eliminate the motorized cam device 54 of the first embodiment or the film holding arm 64 of the second embodiment from the guide arm 22, as discussed above.

OPERATION OF THE WRAPPING APPARATUS

The operation of the wrapping apparatus 20 will now be described in detail with reference to the example first embodiment as shown in the drawings. This sequence of operational steps is described with respect to the first embodiment, but may also be used with respect to the second embodiment as disclosed, or other equivalents.

(1) An operator places the coil 26 onto the coil car 24 and moves the coil car 24 into position into the guide arm assembly 22 (see FIGS. 1A–D).

(2) The operator enters, via a touch screen on an operator's console (not shown), the outside diameter of the coil 26 to be wrapped, the width and diameter of the film spool 50, the inside diameter of the coil 26 to be wrapped, and the amount of film material exposure desired.

(3) The operator adjusts the position of the coil 26 such that the coil's inside diameter is properly positioned with respect to a ring member 40 on the guide arm assembly 22.

(4) The operator may need to preset the desired tension on the film carriage spools 50 and/or replace the wrapping material based on the customer's requirements.

(5) The operator then presses a "start position" function on the console to rotate spool #1 to a threading position.

(6) The operator attaches the wrapping from spool #1 to the coil.

(7) The operator then presses a "continue position" function on the console to rotate spool #2 to a threading position.

(8) The operator attaches the wrapping from the spool #2 to the coil.

(9) The "start" function is pressed on the consule to begin the wrapping process. As the process begins, the ring member 40 begins to rotate counterclockwise and the guide frame 42 begins to oscillate (left-right), such that when a spool enters the coil's 26 central axial opening, the guide frame 42 is at an extreme left position. As that particular spool continues through the coil's 26 central axial opening, the guide frame 42 now begins to move to the right position. When that spool exits the coil 26, the guide frame 42 continues to move to the extreme right position and awaits the next spool. Also, during this step, the coil 26 is rotated, clockwise, by the coil car wheels 28 of the coil car 24 (This description pertains to the first embodiment and is modified by the use of the film holding arm in the second embodiment).

(10) The operator may adjust the speed of the ring member 40 during the wrapping process from the consule.

(11) When the wrapping process is complete, the operator presses a "park" function to rotate the ring member 40 to a ring open position.

(12) The wrapping material is then cut and the ends are attached to the coil 26.

(13) The operator can now remove the coil 26 using the coil car 24.

(14) The process can now be repeated by loading another unwrapped coil 26.

Although the invention has been shown and described with respect to certain embodiments, it is obvious that equivalent alterations and modifications will occur to others skilled in the art upon reading and understanding of the specification. The present invention includes all such equivalent alterations and modifications, and is limited only by the scope of the claims.

What is claimed is:

1. Apparatus for wrapping articles having a central axial opening in film material comprising:

a base frame;

a guide frame mounted on the base frame;

a ring member comprising a split frame having an inside and outside diameter;

a ring member support mounted upon the guide frame for supporting the ring member as the ring member rotates about a ring axis and through the central axial opening;

a film carriage member mounted upon the ring member for wrapping the film material about the article during rotation of the ring member about the ring axis; and a ring driver for rotating the ring member about the ring axis including means for causing the film carriage member to follow an orbital path.

2. The apparatus of claim 1 wherein the orbital path is non-circular.

3. The apparatus of claim 1 wherein the film carriage member follows a circular path and an article turning gear is provided with an oscillating motion synchronized with the rotation of the article.

4. The apparatus of claim 1 wherein the diameters of the ring member are sized to minimize a chordal opening distance on the ring member.

5. The apparatus of claim 1 further comprising an article turning gear for rotating the article wherein rotation of the ring is synchronized with the rotation of the article.

6. The apparatus of claim 1 wherein the means for causing the film carriage member to follow an orbital path comprises a film holding arm, the film carriage member is attached to one end of the film holding arm and the other end of the film holding arm is mounted onto the ring member.

7. The apparatus of claim 1 wherein the ring driver for rotating the ring member about the ring axis comprises a wheel mounted upon the guide frame, rotatable about a vertical axis, and in frictional engagement with the outside diameter of the ring member.

8. The apparatus of claim 7 wherein the wheel mounted upon the guide frame is a drive wheel driven by a motor with gear reduction.

9. The apparatus of claim 7 further comprising means for radially adjusting the drive wheel relative to the ring axis.

10. The apparatus of claim 1 wherein the guide frame is slidably mounted onto the base frame and the means for providing the orbital path for the film carriage member comprises a motorized cam device connected to the guide frame.

11. The apparatus of claim 10 wherein the guide frame is mounted on linear ball slides attached to the base frame.

12. The apparatus of claim 1 wherein the ring member support supports both the inside and outside diameters of the ring member and comprises a plurality of guide rolls mounted upon the guide frame, angularly spaced apart about the ring axis, rotatable about vertical axes, and disposed adjacent to both the inside and outside diameters of the frame of the ring member.

13. The apparatus of claim 12 further comprising means for radially adjusting the guide rollers relative to the ring axis.

14. Apparatus for wrapping articles having a central axial opening in film material comprising:

frame means for receiving the article to be wrapped;

a ring member comprising a split frame having an inside and outside diameter;

means for supporting the ring member upon the frame means for rotation of the ring member about a ring axis and through the central axial opening;

film carriage means mounted upon the ring member for wrapping the film material about the article during rotation of the ring member about the ring axis; and means for rotating the ring member about the ring axis including means for causing the film carriage means to follow an orbital path.

15. The apparatus of claim 14 wherein the orbital path is non-circular.

16. The apparatus of claim 14 wherein the film carriage means follows a circular path and an article turning gear is provided with an oscillating motion synchronized with the rotation of the article.

17. The apparatus of claim 14 wherein the diameters of the ring member are sized to minimize a chordal opening distance on the ring member.

18. The apparatus of claim 14 further comprising an article turning gear for rotating the article wherein rotation of the ring is synchronized with the rotation of the article.

19. The apparatus of claim 14 wherein the means for causing the film carriage member to follow an orbital path comprises a film holding arm, the film carriage means is attached to one end of the film holding arm and the other end of the film holding arm is mounted onto the ring member.

20. The apparatus of claim 14 wherein the means for rotating the ring member comprises a wheel mounted upon the frame means, rotatable about a vertical axis, and in frictional engagement with the outside diameter of the ring member.

21. The apparatus of claim 20 wherein the wheel mounted upon the frame means is a drive wheel driven by a motor with gear reduction.

22. The apparatus of claim 20 further comprising means for radially adjusting the drive wheel relative to the ring axis.

23. The apparatus of claim 14 wherein the means for supporting the ring member supports both the inside and outside diameters of the ring member and comprise a plurality of guide rolls mounted upon the frame means, angularly spaced apart about the ring axis, rotatable about vertical axes, and disposed adjacent to both the inside and outside diameters of the frame of the ring member.

24. The apparatus of claim 23 further comprising means for radially adjusting the guide rollers relative to the ring axis.

25. The apparatus of claim 14 wherein the means for causing the film carriage means to follow an orbital path comprises a motorized cam device mounted on the frame means.

* * * * *